US009604822B2

(12) United States Patent
Roivainen et al.

(10) Patent No.: US 9,604,822 B2
(45) Date of Patent: Mar. 28, 2017

(54) ELEVATOR

(71) Applicant: KONE CORPORATION, Helsinki (FI)

(72) Inventors: Gabriela Roivainen, Hyvinkää (FI); Iiro Heinonen, Hyvinkää (FI); Jaakko Kalliomäki, Vantaa (FI); Mikko Vesterinen, Helsinki (FI)

(73) Assignee: KONE CORPORATION, Helsinki (FI)

( * ) Notice: Subject to any disclaimer, the term of this patent is extended or adjusted under 35 U.S.C. 154(b) by 0 days.

(21) Appl. No.: 14/950,195

(22) Filed: Nov. 24, 2015

(65) Prior Publication Data

US 2016/0167927 A1 Jun. 16, 2016

(30) Foreign Application Priority Data

Dec. 12, 2014 (EP) ..... 14197804

(51) Int. Cl.
*B66B 13/30* (2006.01)
*B66B 13/28* (2006.01)

(52) U.S. Cl.
CPC ..... *B66B 13/301* (2013.01); *B66B 13/285* (2013.01)

(58) Field of Classification Search
CPC ..... B66B 13/301; B66B 13/285
USPC ..... 187/334
See application file for complete search history.

(56) References Cited

U.S. PATENT DOCUMENTS 2,027,920 A * 1/1936 Lindquist ..... B66B 13/301 49/411
4,781,270 A * 11/1988 Holland ..... B66B 13/08 187/313
5,080,003 A * 1/1992 Kappeler ..... B66B 11/024 187/401
5,165,505 A * 11/1992 Hayashi ..... B66B 13/08 187/333
5,251,726 A * 10/1993 de Jong ..... B66B 13/285 187/401

(Continued)

FOREIGN PATENT DOCUMENTS

EP 0517130 A1 12/1992
EP 0603681 A1 6/1994

(Continued)

*Primary Examiner* — Michael Riegelman
(74) *Attorney, Agent, or Firm* — Birch, Stewart, Kolasch & Birch, LLP

(57) ABSTRACT

An elevator includes at least one elevator car driving in an elevator shaft driven by an elevator drive. The elevator car has at least one car door and a door sill at the bottom of the car door, which door sill includes at least one groove, in which the car door is guided, in which groove at least one trash hole is located to prevent trash from accumulating in the groove, whereby the elevator car further includes a toe guard which extends downwards from the door sill. The trash hole is connected with a first upper end of an air channel extending downwards from the door sill and includes at least one channel portion extending with a direction component in a horizontal direction and/or having an opening directed sideward, which air channel is connected with the toe guard. The elevator leads to a reduced noise generation in the region of the door sill, particularly in elevator cars traveling with a high speed.

20 Claims, 3 Drawing Sheets

(56) References Cited

U.S. PATENT DOCUMENTS

Figure 1:
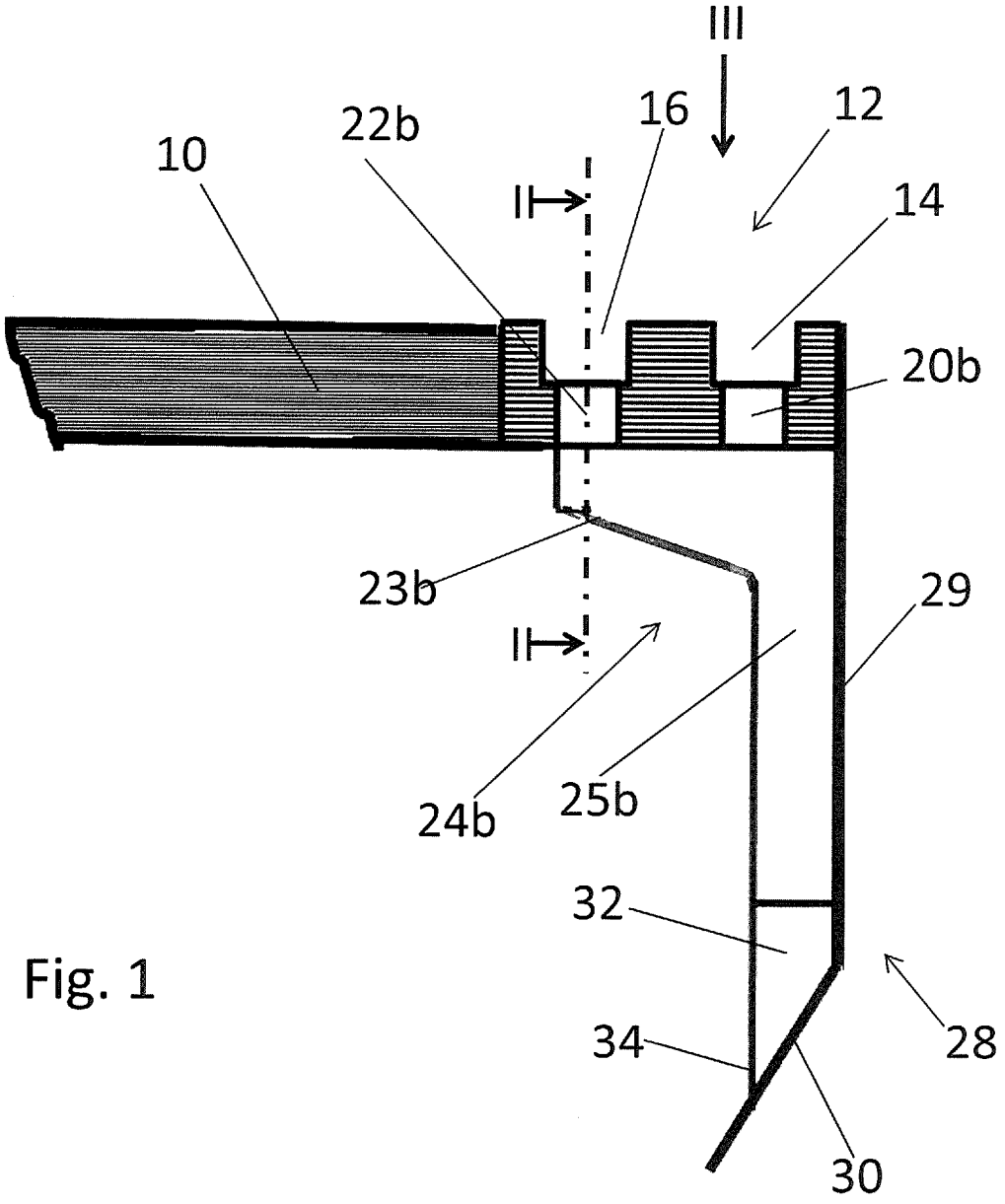

| | | | | | |
|---|---|---|---|---|---|
| 5,464,073 | A * | 11/1995 | de Jong | B66B 13/301 | 187/334 |
| 5,715,913 | A * | 2/1998 | De Jong | B66B 13/301 | 187/334 |
| 2005/0210768 | A1* | 9/2005 | Lawson | E06B 1/70 | 52/97 |
| 2006/0230593 | A1* | 10/2006 | Eggen | E06B 1/62 | 29/428 |
| 2012/0266968 | A1* | 10/2012 | Bloch | B66B 11/0226 | 137/1 |
| 2016/0167924 | A1* | 6/2016 | Roivainen | B66B 11/0226 | 187/401 |

FOREIGN PATENT DOCUMENTS

| | | | |
|---|---|---|---|
| JP | 5-78071 | A | 3/1993 |
| WO | WO 2013/132151 | A1 | 9/2013 |

* cited by examiner

ELEVATOR

The present invention relates to an elevator having at least one elevator car driving in an elevator shaft driven by an elevator drive. The elevator car has at least one car door and a door sill at the bottom of the car door on the same level as the floor of the elevator car. The door sill comprises at least one groove, in which the car door is guided whereby in the groove at least one trash hole is located to prevent trash from accumulating in the groove. Particularly in fast running elevators, these trash holes generate not unessential noise which could increase the noise volume in the elevator car possibly to values about 3 dB.

The WO 2013/132151 describes an elevator comprising at least one elevator car driving in an elevator shaft driven by an elevator drive.

It is therefore object of the invention to provide an elevator, particularly fast running elevator, having a reduced noise generation.

The object of the invention is solved with an elevator comprising at least one elevator car driving in an elevator shaft driven by an elevator drive, which elevator car has at least one car door and a door sill at the bottom of the car door, which door sill comprises at least one groove, in which the car door is guided, in which groove at least one trash hole is located to prevent trash from accumulating in the groove, whereby the elevator car further comprises a toe guard which extends with a direction component in length direction of the shaft, characterized that the trash hole is connected with a first upper end of an air channel extending downwards from the door sill and comprises at least one channel portion extending with a direction component in horizontal direction and/or having an opening directed sideward, which air channel is connected with the toe guard. Advantageous embodiments of the invention are subject-matter of the dependent claims. Inventive embodiments are also presented in the description and in the drawings of the present application. The inventive content may also consist of several separate inventions, especially if the invention is considered in the light of explicit or implicit subtasks or with respect to advantages or sets of advantages achieved. In this case, some of the attributes contained in the claims below may be superfluous from the point of view of separate inventive concepts.

According to the invention, the trash hole is connected with a toe guard which extends downwards at the landing side edge of the door sill. According to the invention, the trash hole is connected with a first upper end of an air channel extending downwards from the door sill and comprises at least one channel portion extending with a direction component in horizontal direction, which air channel is connected with the toe guard. The feature that the air channel extends in a direction having a horizontal direction component comprises at least channel portions which extend in horizontal direction or which are tilted with respect to a straight vertical direction by at least 10 degrees, particularly by at least 20 degrees, preferably up to 45 degrees. Of course, the channel may also extend vertically but may include inner portions which are separated so as to extend in a horizontal direction or with a horizontal direction component. The extension of the air channel with a horizontal direction component ensures that the channel is not directed exactly vertically. Alternatively or additionally to the air channel portion extending with a horizontal component the lower opening of the air channel may be directed sideward, so that the air cannot directly enter the air channel when the elevator car is traveling downwards. Thus the blowing of air directly through the air channel with high velocity during the travel of the car is prevented, which reduces noise.

This air channel having at least also a horizontal extension component acts as a kind of obstacle and therefore prevents wind from blowing from directly upwards or downwards through the trash holes when the car moves upwards or downwards with nominal velocity. By the horizontal direction component it is ensured that the wind is at least diverted which reduces the wind speed through the air channel and thus reduces generated noise.

Therefore, the air channel preferably forms an acoustic labyrinth. This acoustic labyrinth not only reduces the velocity of the wind blowing through the air channel and the trash hole but also reduces noise which is generated by said wind. The air channel may also reduce noise which comes from the elevator shaft.

Preferably, the door sill comprises at least one trash hole, preferably two trash holes, only in its central portion (if the car door is a centrally closing door). Usually, trash accumulating in the groove is pushed by the guide of the elevator door towards the trash hole. Therefore, the location of the trash hole is advantageous in the region of the end position of the door guide when the door is closed. As usually there is a centrally closing car door with two door leaves, two trash holes in the central part of the door sill are preferable.

Therefore, if two trash holes are provided in the central portion, these trash holes are connected with corresponding air channels, whereby the two air channels extend in a mutual angle of 25 to 90 degrees. By this measure, the air channel has a horizontal component which tends to reduce the airflow in the channel, and on the other hand, the fact that the two air channels are directed away from each other leads to a better stiffening of the toe guard via the air channels over the complete width of the toe guard. Of course also both trash holes could be connected to a common air channel which is tilted towards the vertical direction and/or has horizontally extending portions.

In the invention, the air channel has an outlet opening at its second lower end which outlet opening is directed in horizontal direction, i.e. the normal vector of the opening extends in horizontal direction. This means that the edges of the opening are preferably in a vertical plane. The orientation of the lower outlet openings of the air channel in horizontal direction has the advantage that the wind cannot blow directly from below into the air channels when the elevator car moves downwards but the wind has to take a path from aside into the air channel. Thus, this measure essentially reduces wind entering the air channel and reduces airflow speed within the air channel.

Of course, the air channel could also have a downwards (vertical) opening which is horizontally offset with respect to the corresponding trash-hole(s) in the door sill, which also leads to a reduced air velocity in the air channel.

In a preferred embodiment of the invention, the air channel forms a bracing element stiffening the toe guard. For example, the air channels can be provided as a U-profile metal sheet which is fixed to the toe guard plate which is also preferably a metal plate. This fixing can be done with screwing or with welding or other connection techniques. By the fact that the toe guard is on its inner side stiffened by these U-profiles leads to an essential stiffening of the toe guard plate via the air channels. Accordingly, the air channels act as a bracing element which reduces vibrations of the toe guard during the ride in the elevator shaft and therefore furthermore reduce the noise level in the shaft and thus the noise level in the elevator car improving riding comfort of the elevator car.

In a preferred embodiment of the invention, the air channel as well as the toe guard are formed of sheet metal which is easy to manufacture. In this case also the connection between the air channel and the toe guard can be realized technically simple, e.g. via welding points. Generally, as it is per se known the toe guard extends from the door sill in vertical direction downwards as it is most preferable for the protection of passengers.

Preferably, the groove does not have any trash holes outside of a central portion of preferably 30 cm, particularly 20 cm of the door sill. By omitting the currently used trash holes at the outer end portions of the grooves, the noise level can be reduced. These outer trash holes have revealed to be only of minor importance regarding the discharge of waste in the grooves. Therefore, on that behalf, the location of the trash holes only in the central portion has been revealed sufficient for waste discharge and advantageous with respect to noise reduction.

Preferably, the car door is guided by door rollers or pins running in the groove of the door sill. This arrangement has been established as a functional and a reliable element in a per se known manner.

In a preferred embodiment of the invention, the second lower end of the air channel does not have any opening extending downwards. Via this measure, it is avoided that wind enters the air channel directly from below when the elevator car is travelling downwards. Thus, air speed in the air channel is reduced to a minimum and the resulting generated noise is reduced.

The invention also refers to an elevator group having several elevators according to the above-mentioned specifications.

It shall be clear for the skilled person that the above-mentioned embodiments can be combined with each other as long as it is technically feasible.

The invention is now described in the drawings by means of an example, wherein

Figure 2:
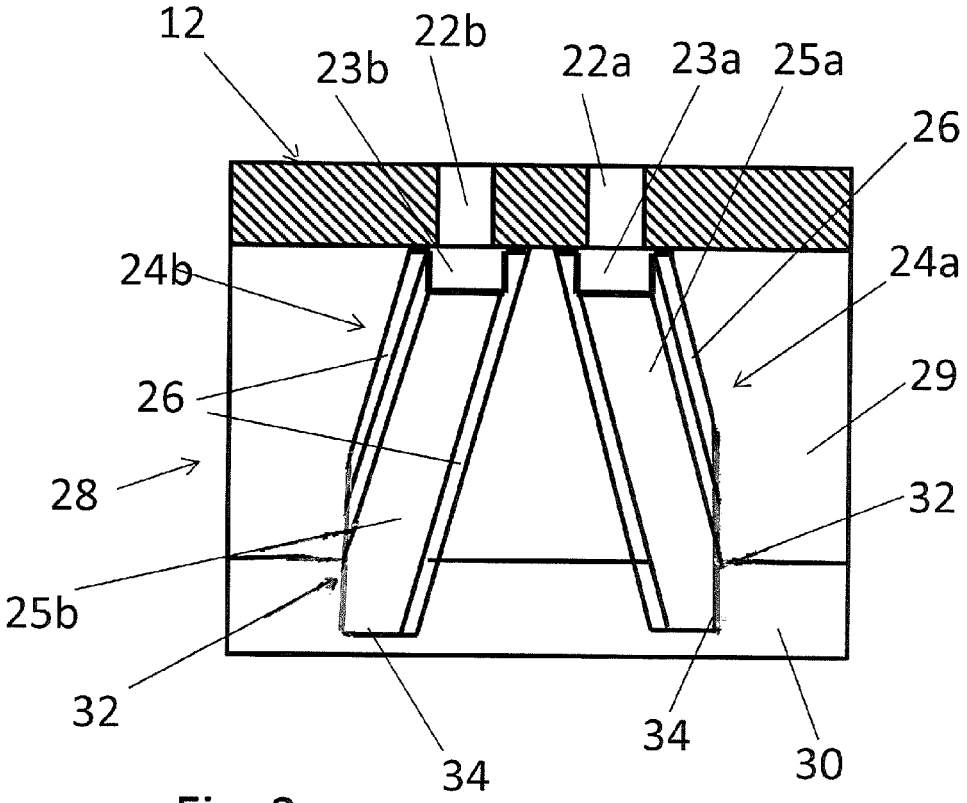
Figure 3:
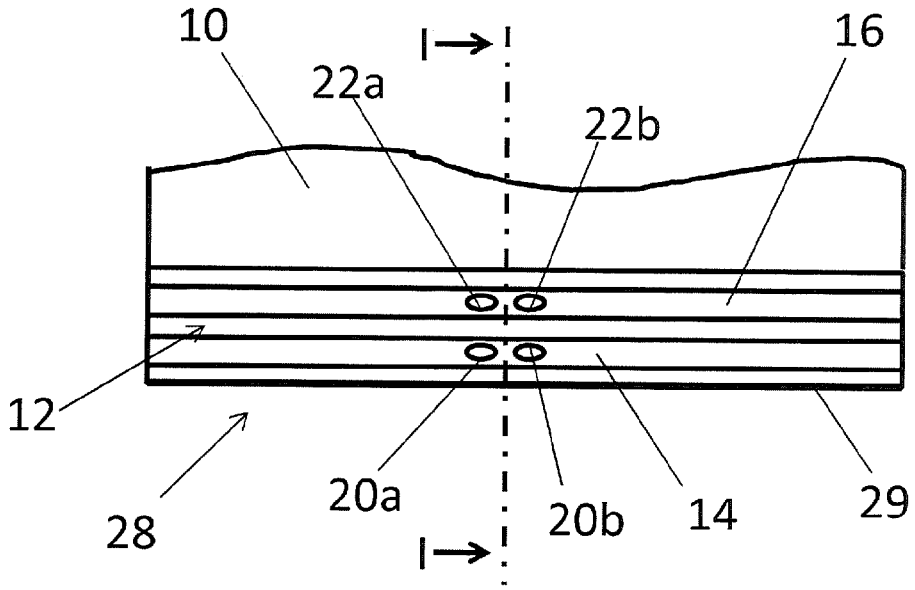

FIG. 1 shows a vertical section of a part of an elevator car in the region of the door sill and toe guard, FIG. 2 shows a vertical section II-II from FIG. 1, and FIG. 3 shows a top view III from FIG. 1.

FIG. 1 shows the floor 10 of an elevator car which is at the car door side terminated by a door sill 12 having two parallel grooves 14, 16 for guiding the car doors between their open and closed position. The two grooves 14, 16 have two trash holes 20*a*, 20*b*, 22*a*, 22*b* respectively, which are on their bottom side connected with a horizontally extending first portion 23*a*, 23*b* of an air channel 24*a*, 24*b*. The first portion 23*a,b* has a sloped bottom to assist the trash entering through the trash-hole(s) to advance to a vertically extending second portion 25*a*, 25*b* which is also tilted with respect to the vertical by about 15 degrees (See FIG. 2). The air channels 24*a*, 24*b* are embodied as a U-profile made of a metal sheet, which profile has flat extensions 26 which with the second air channel portion 25*a*, 25*b* is welded to a toe guard 28. The toe guard 28 has a first upper portion 29 extending from the front edge of the door sill 12 vertically downwards and a second lower portion 30 which is directed vertically downwards but slightly tilted inwards to the car. The air channel 24 has at its lower end 34 an outlet opening 32 which is open to the side, i.e. extending horizontally (their normal vector pointing horizontally, which means the edges of the opening lying in a vertical plane), so that air cannot enter the air channel directly from below as the lower end 34 of the air channels 24*a*, 24*b* closes to the bent portion 30 of the toe guard plate 28.

Both air channels 24*a*, 24*b* are extending in a mutual angle of about 30 degrees, i.e. 15 degrees with respect to the vertical direction which leads to a better noise reduction and to a better distribution of the bracing effect of the air channels 24*a*, 24*b* along the toe guard 28.

By the first upper horizontal portions 23*a*, 23*b* and by the tilting or inclination of the second lower portions 25*a*, 25*b* with respect to the vertical direction as well as by the sideward directed outlet openings 32 of the air channels 24*a*, 24*b*, the air channel forms an acoustic labyrinth and reduces noise created by the trash holes 20*a,b* and 22*a,b* essentially.

It is clear, that the above-mentioned embodiment can be varied according to design necessities. For example, the door sill 12 comprises two grooves 12, 14. The door sill may also comprise only one groove or three or four grooves according to the number of door leaves to be guided. The shown door sill is a door sill for a centrally opening car door. If the door opens to one side, the trash holes are of course located at that side where the door closes.

Instead of two trash holes per groove, also one or three trash holes may be provided. The geometry of the trash holes is shown as elliptic. The trash holes can of course have a rectangular or circular form as desired.

The toe guard 28 consists of a vertical first upper part 29 and an inwardly bent lower part 30. Of course, the toe guard can be embodied as one single plate which is extending vertically or which is smoothly curved inwardly.

The toe guard as well as the air channels need not to be manufactured from sheet metal but may also consist of other materials, e.g. plastics.

The invention claimed is:

1. An elevator comprising:

at least one elevator car driving in an elevator shaft driven by an elevator drive, wherein the at least one elevator car has at least one car door and a door sill at a bottom of the car door, the door sill comprising at least one groove, in which the car door is guided, in which groove at least one trash hole is located to prevent trash from accumulating in the groove, wherein the elevator car further comprises a toe guard extending with a direction component in a length direction of the elevator shaft, wherein each of the at least one trash hole is connected with a first upper end of an air channel extending downwards from the door sill, wherein the air channel comprises at least one channel portion extending with a direction component in a horizontal direction and an opening directed in the horizontal direction, the air channel is connected with the toe guard, and the air channel having an outlet opening at a second lower end thereof directed in the horizontal direction, wherein the horizontal direction is perpendicular to the length direction of the elevator shaft, and wherein the downward direction faces the bottom of the elevator shaft.

2. The elevator according to claim 1, wherein the air channel forms an acoustic labyrinth.

3. The elevator according to claim 2, wherein the groove of the door sill comprises at least one trash hole only in a central portion thereof, and wherein the central portion is located substantially at the center of both a length and a width of the groove.

4. The elevator according to claim 2, wherein the air channel forms a bracing element stiffening the toe guard.

5. The elevator according to claim 1, wherein the groove of the door sill comprises at least one trash hole only in a central portion thereof, and wherein the central portion is located substantially at the center of both a length and a width of the groove.

6. The elevator according to claim 5, wherein the toe guard comprises at least one plate-like member.

7. The elevator according to claim 6, wherein two trash holes are provided in the groove, wherein air channels of the two trash holes extend in a mutual angle of 25 to 90 degrees with respect to the length direction.

8. The elevator according to claim 6, wherein the air channel forms a bracing element stiffening the toe guard.

9. The elevator according to claim 5, wherein the air channel forms a bracing element stiffening the toe guard.

10. The elevator according to claim 1, wherein the air channel forms a bracing element stiffening the toe guard.

11. The elevator according to claim 10, wherein the air channel comprises or consist of a U-profile fixed the toe guard.

12. The elevator according to claim 1, wherein several trash holes are located in a central portion of the groove which are connected to several correlated air channels, which are tilted with respect to the length direction, and wherein the central portion is located substantially at the center of both a length and a width of the groove.

13. The elevator according to claim 1, wherein the air channels and toe guard are formed of sheet metal.

14. The elevator according to claim 1, wherein the toe guard and at least a part of the air channel extend from the door sill in the downward direction.

15. The elevator according to claim 1, wherein the groove does not have any trash holes outside a central portion of 30 cm, and wherein the central portion is located substantially at the center of both a length and a width of the groove.

16. The elevator according to claim 1, wherein the elevator comprises door rollers which run in the groove of the door sill.

17. The elevator according to claim 1, wherein the second lower end of the air channel does not have any opening extending downwards.

18. An elevator group comprising several of the elevators according to claim 1.

19. The elevator according to claim 1, wherein several trash holes are located in a central portion of the groove which are connected to several correlated air channels, which are tilted with respect to the length direction at an angle of 10 to 45 degrees and wherein the central portion is located substantially at the center of both a length and a width of the groove.

20. The elevator according to claim 1, wherein the groove does not have any trash holes outside a central portion of 20 cm, and wherein the central portion is located substantially at the center of both a length and a width of the groove.

* * * * *